US011217137B2

(12) United States Patent
Nakai

(10) Patent No.: US 11,217,137 B2
(45) Date of Patent: Jan. 4, 2022

(54) DRIVE CIRCUIT AND DISPLAY DEVICE

(71) Applicant: SHENZHEN TOREY MICROELECTRONIC TECHNOLOGY CO. LTD., Shenzhen (CN)

(72) Inventor: Takahiro Nakai, Sakai (JP)

(73) Assignee: SHENZHEN TOREY MICROELECTRONIC TECHNOLOGY CO. LTD., Shenzhen (CN)

( * ) Notice: Subject to any disclaimer, the term of this patent is extended or adjusted under 35 U.S.C. 154(b) by 0 days.

(21) Appl. No.: 16/441,813

(22) Filed: Jun. 14, 2019

(65) Prior Publication Data

US 2019/0385505 A1 Dec. 19, 2019

Related U.S. Application Data

(60) Provisional application No. 62/685,488, filed on Jun. 15, 2018.

(51) Int. Cl.
*G09G 3/20* (2006.01)
*G09G 3/36* (2006.01)

(52) U.S. Cl.
CPC ..... *G09G 3/20* (2013.01); *G09G 3/3696* (2013.01); *G09G 3/2022* (2013.01); *G09G 3/3688* (2013.01); *G09G 2310/027* (2013.01); *G09G 2310/0297* (2013.01); *G09G 2310/08* (2013.01); *G09G 2330/021* (2013.01)

(58) Field of Classification Search
CPC ..... G09G 3/20; G09G 3/2022; G09G 3/3696; G09G 3/3688; G09G 2310/08; G09G 2310/027; G09G 2310/0291; G09G 2310/0297; G09G 2320/0233; G09G 2320/0252; G09G 2330/021
USPC ..... 345/204, 98–100
See application file for complete search history.

(56) References Cited

U.S. PATENT DOCUMENTS

| | | | | |
|---|---|---|---|---|
| 8,089,437 | B2 * | 1/2012 | Maekawa | G09G 3/3655 345/212 |
| 8,456,455 | B2 * | 6/2013 | Kojima | G09G 3/3291 345/204 |
| 2006/0214897 | A1 * | 9/2006 | Murai | G09G 3/3648 345/89 |
| 2008/0019159 | A1 * | 1/2008 | Song | G09G 3/3688 363/62 |
| 2008/0204439 | A1 * | 8/2008 | Morita | G09G 3/3688 345/209 |
| 2010/0220080 | A1 | 9/2010 | Kojima et al. | |
| 2013/0342520 | A1 * | 12/2013 | Tsuchi | G09G 3/3688 345/211 |

FOREIGN PATENT DOCUMENTS

JP 2010-204312 A 9/2010

* cited by examiner

*Primary Examiner* — Jimmy H Nguyen
(74) *Attorney, Agent, or Firm* — ScienBiziP, P.C.

(57) ABSTRACT

A driving circuit and a display device, to realize the drive circuit where settling time (stabilization time) is shortened, comprise power source lines for discharge (DCL1 through DCLJ). Each input node of a plurality of source amps (AMn) is electrically connected to the power source line for discharge (DCL1) during a first period and a second period in which a DAC circuit (2) supplies a gray scale reference voltage (V0 to V255) that has been selected to each of the plurality of source amps (AMn).

10 Claims, 13 Drawing Sheets

| | |
|---|---|
| 1: SOURCE DRIVE CIRCUIT | 10: DISPLAY DEVICE |
| 4: GATE DRIVE CIRCUIT | G1, G2, Gm: GATE LINES |
| 5: DISPLAY PANEL | S1, Sr: SOURCE LINES |

--RELATED ART--

--RELATED ART--

-- RELATED ART--

DRIVE CIRCUIT AND DISPLAY DEVICE

TECHNICAL FIELD

The present invention relates to a drive circuit that drives a display panel, and a display device having the drive circuit.

BACKGROUND ART

There is need for even faster output delay in display driver ICs (drive circuits) for liquid crystal display panels, organic EL (Electro Luminescence: electroluminescence) panels having OLED (Organic Light Emitting Diode: organic light-emitting diode), and so forth, due to high definition, handling double-speed driving, and so forth, of panels in recent years.

FIG. 11 is a diagram illustrating a conventional source drive circuit that performs multiplexed driving where multiple (e.g., 18) source lines are driven by time division.

As illustrated in (a) in FIG. 11, the conventional source drive circuit includes multiple source amps AM1 through AM171, a gamma circuit 24 that outputs gray scale reference voltages V0 through V255, a DAC circuit 23 that selects one from a 256 count of gray scale reference voltages V0 through V255 supplied via each of a 256 count of respective gray scale reference voltage bus lines from the gamma circuit 24, based on each of gray scale values of input image data D1 through D171, and supplies to each of multiple source amps AM1 through AM171, and a demultiplexer 25 that distributes voltages output from, respective output nodes Q1 through Q171 of the multiple source amps AM1 through AM171 to source lines S1 through S3078 by time division based on voltage select signals SEL1 through SEL18.

(b) in FIG. 11 illustrates a configuration example of the DAC circuit 23 and gamma circuit 24. The gamma circuit 24 disposed on both the right and left side of the DAC circuit 23 includes resistor elements RA1 through RA257 and resistor elements RB1 through RB257 that divide between high-potential side voltage VH and low-potential side voltage VL. Nodes between the resistor elements RA1 through RA257 and nodes between the resistor elements RB1 through RB257 are connected to common reference voltage bus lines BL1 through BL256. Gray scale reference voltages V0 through V255 are output to each of the reference voltage bus lines BL1 through BL256.

The DAC circuit 23 has switch elements S1-1 through S171-256 connected between each of the multiple source amps AM1 through AM171, and each of the reference voltage bus lines BL1 through BL256. On and off control of the switch elements S1-1 through S171-256 is controlled based on each gray scale value of the image data D1 through D171. For example, in a case where the image data D171 is gray scale 127 (equivalent to gray scale reference voltage V127), only the switch element S171-128 is on out of the switch elements S171-1 through S171-256, the other switch elements S171-1 through S171-127 and S171-129 through S171-256 are off, and the gray scale reference voltage V127 is supplied to an input node U171 of the source amp AM 171.

FIG. 12 is a diagram for describing problems with the conventional source drive circuit illustrated in FIG. 11.

FIG. 13 is a diagram for describing a case where the above problem becomes markedly pronounced in the conventional source drive circuit.

In the case of the conventional source drive circuit 100 illustrated in FIG. 13 for example, in a case where all of each of the gray scale values of image data D1 through Dn are gray scale 1 (equivalent to gray scale reference voltage V1) for example, all of the input nodes U1 through Un of the n count of source amps AM1 through AMn are electrically connected to reference voltage bus line BL2 where the gray scale reference voltage V1 is output.

(a) in FIG. 12 is a diagram illustrating a schematic configuration of source amp AMn, where the input node Un and output node Qn of the source amp AMn are connected to the gates of an input transistor Mp and output transistor Mm that are transistors in the source amp AMn, and gate capacitance of the input transistor Mp (indicated by dotted line in the drawing) and gate capacitance of the output transistor Mm (indicated by dotted line in the drawing) are formed. In a case where all of the input nodes U1 through Un of the n source amps AM1 through AMn are electrically connected to one of the reference voltage bus lines BL1 through BL256 (reference voltage bus line BL2 in the case of FIG. 13) that outputs one of the gray scale reference voltages V0 through V255 as illustrated in FIG. 13, the load on a particular reference voltage bus line (reference voltage bus line BL2 in the case of FIG. 13) increases due to the effects of the gate capacitance. That is to say, the greater the number is of input nodes U1 through Un of the source amps AM1 through AMn electrically connected to a certain one of the reference voltage bus lines BL1 through BL256, the greater the load on the certain one of the reference voltage bus lines BL1 through BL256. Also, the greater the difference between the gray scale value of the image data D1 through Dn input the previous time and the gray scale value of the image data D1 through Dn input this time is, such as in a case of each of the image data D1 through Dn changing from gray scale 0 (equivalent to gray scale reference voltage V0) to gray scale 255 (equivalent to gray scale reference voltage V255), the greater the load on the certain one of the reference voltage bus lines BL1 through BL256.

(b) in FIG. 12 is a diagram illustrating change in the output of a certain reference voltage bus line BL256 due to effects of the gate capacitance in a case where the load on the reference voltage bus line BL256 is greatest. As illustrated in (b) in FIG. 12, when each of the image data D1 through Dn changes from gray scale 0 to gray scale 255, the output of the reference voltage bus line BL256 rises in the V0 direction that is the arrow direction in the drawing due to movement of the charge accumulated in the gate capacitance (in a case where V0>V255 as illustrated in (b) in FIG. 11). That is to say, when each of the image data D1 through Dn changes from gray scale 0 to gray scale 255, the output of the reference voltage bus line BL256 becomes higher voltage than the expected value of V255. Note that this amount of rise becomes greater the greater the number of input nodes U1 through Un of the source amps AM1 through AMn electrically connected to a certain reference voltage bus line BL1 through BL256 becomes.

(c) in FIG. 12 is a diagram illustrating source output at the respective output nodes Qn of the multiple source amps AMn electrically connected to the reference voltage bus line BL256 in a case where a rise has occurred in the output of the reference voltage bus line BL256, as illustrated in (b) in FIG. 12. When each of the image data D1 through Dn change from gray scale 0 to gray scale 255, the time it takes for stabilization of the source output from a V0 expected value equivalent to the gray scale 0 to near a V255 expected value equivalent to the gray scale 255 (settling time) increases due to the effects of the above-described rise, as illustrated in (c) in FIG. 12. This is problematic in a display device that has a source drive circuit with a large settling time, since there are cases where insufficient gray level in display, display noise, uneven display, and so forth, are visually recognizable.

PTL 1 discloses a configuration where output from the output nodes Qn of the multiple source amps AMn is discharged to an external power source.

CITATION LIST

Patent Literature

[PTL 1] Japanese Unexamined Patent Application Publication No. 2010-204312 (Disclosed Sep. 16, 2010)

SUMMARY OF INVENTION

Technical Problem

However, in a case of the configuration disclosed in PTL 1, output from, the output nodes Qn of the multiple source amps AMn is discharged to an external power source, so the charge in the input node Un side of the multiple source amps AMn remains stored, so there is a problem that occurrence of rapid potential change at the time of switching gray scales is unavoidable.

Due to increased definition of display panels in recent years, the number of the multiple source amps AMn connected to a certain reference voltage bus line at the same time is great at the input node Un side of the multiple source amps AMn as well, so the effect of gate capacitance described above is great, which is problematic.

An aspect of the present invention has been made in light of the above problem, and it is an object thereof to realize a drive circuit where settling time (stabilization time) is shortened, and a display device where insufficient gray level in display, display noise, uneven display, and so forth, are suppressed.

Solution to Problem (1) An embodiment of the present invention is a drive circuit including: a plurality of source amps; a gray scale reference voltage generating circuit that generates M (where M is a natural number of 2 or greater) different gray scale reference voltages; and a digital/analog conversion circuit that selects one of the M gray scale reference voltages supplied from the gray scale reference voltage generating circuit via each of M bus lines, based on each of input gray scale values, and supplies to each of the plurality of source amps, having at least one power source line. Each input node of the plurality of source amps is electrically connected to the at least one power source line during a first period and a second period in which the digital/analog conversion circuit supplies the gray scale reference voltage that has been selected to each of the plurality of source amps.

According to this configuration, a drive circuit where settling time (stabilization time) is shortened can be realized.

(2) Also, an embodiment of the present invention is a drive circuit where, in addition to the configuration of (1) above, the at least one power source line is made up of a plurality each having different potential, and each input node of the plurality of source amps is electrically connected to one power source line that has a potential closest to the gray scale reference voltage that the digital/analog conversion circuit selects during the second period.

(3) Also, an embodiment of the present invention is a drive circuit where, in addition to the configuration of (1) above or (2) above, each of the plurality of source amps is provided with an input transistor at the input node side, and an output transistor at an output node side, and the input transistor and the output transistor are electrically connected to one of the at least one power source line during the first period and the second period.

(4) Also, an embodiment of the present invention is a drive circuit where, in addition to the configuration of any one of (1) above through (3) above, the at least one power source line is a power source line that is different from the bus lines, and is a power source line for discharging to which one of the gray scale reference voltages is supplied.

(5) Also, an embodiment of the present invention is a drive circuit where, in addition to the configuration of any one of (1) above through (3) above, the at least one power source line is an external power source line.

(6) Also, an embodiment of the present invention is a drive circuit where, in addition to the configuration of any one of (1) above through (3) above, the at least one power source line is part of the M bus lines.

(7) Also, an embodiment of the present invention is a display device including, in addition to the drive circuit according to any one of (1) above through (6) above, and a display panel.

According to the above configuration, a display device where insufficient gray level in display, display noise, uneven display, and so forth, are suppressed, can be realized.

(8) Also, an embodiment of the present invention is a display device where, in addition to the configuration of (7) above, a switch element is provided to the output node of each of the plurality of source amps, and the switch element is in an off state where the output node of each of the plurality of source amps and the display panel are electrically isolated during the first period and the second period.

Advantageous Effects of Invention

A drive circuit where settling time (stabilization time) is shortened, and a display device where insufficient gray level in display, display noise, uneven display, and so forth, are suppressed, can be realized.

DESCRIPTION OF EMBODIMENTS

Embodiments of the present invention will be described below with reference to FIG. 1 through FIG. 8. Hereinafter, configuration that have the same functions as a configuration described in a particular embodiment may be denoted by the same symbols, and description thereof omitted for the sake of convenience in description.

First Embodiment

A first embodiment of the present invention will be described below with reference to FIG. 1 through FIG. 4.

(Source Drive Circuit 1)

Figure 1:
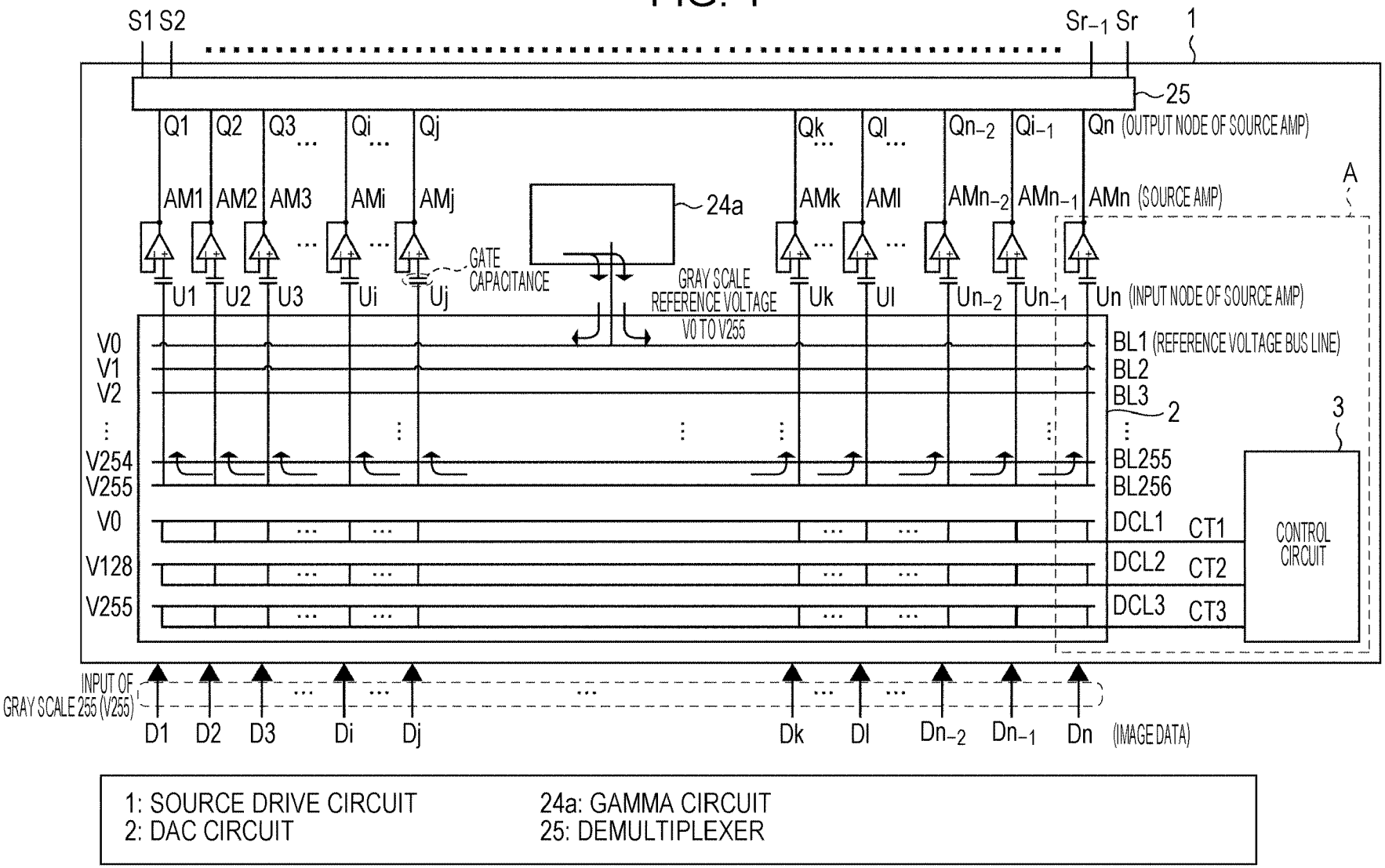
FIG. 1 is a diagram illustrating the overall configuration of a source drive circuit according to a first embodiment of the present invention.

FIG. 1 is a diagram illustrating the overall configuration of a source drive circuit 1 according to the first embodiment of the present invention.

It can be seen from FIG. 1 that the source drive circuit 1 (drive circuit) includes multiple source amps AM1 through AMn, a gamma circuit 24*a* that outputs gray scale reference voltages V0 through V255 and reference voltages V0, V128, and V255, for discharging, a DAC circuit 2 that selects one of a 256 count of gray scale reference voltages V0 through V255 supplied via a 256 count of reference voltage bus lines BL1 through BL256 from the gamma circuit 24*a* based on each of gray scale values from input image data D1 through Dn, and supplies to each of the multiple source amps AM1 through AMn, power source lines DCL1 through DCL3 for discharging, and a control circuit 3 that effects control so as to discharge charge accumulated at an input node side of the multiple source amps to one of the power source lines DCL1 through DCL3 for discharging based on control signals CT1 through CT3. Further included is a demultiplexer 25 that distributes voltage output from each of output nodes Q1 through Qn of the multiple source amps AM1 through AMn to source lines S1 through Sr, in time division based on select signals. The i, j, k, l, n, and r in the drawing are natural numbers, satisfying the relation of $i<j<k<l<n<r$.

Figure 11:
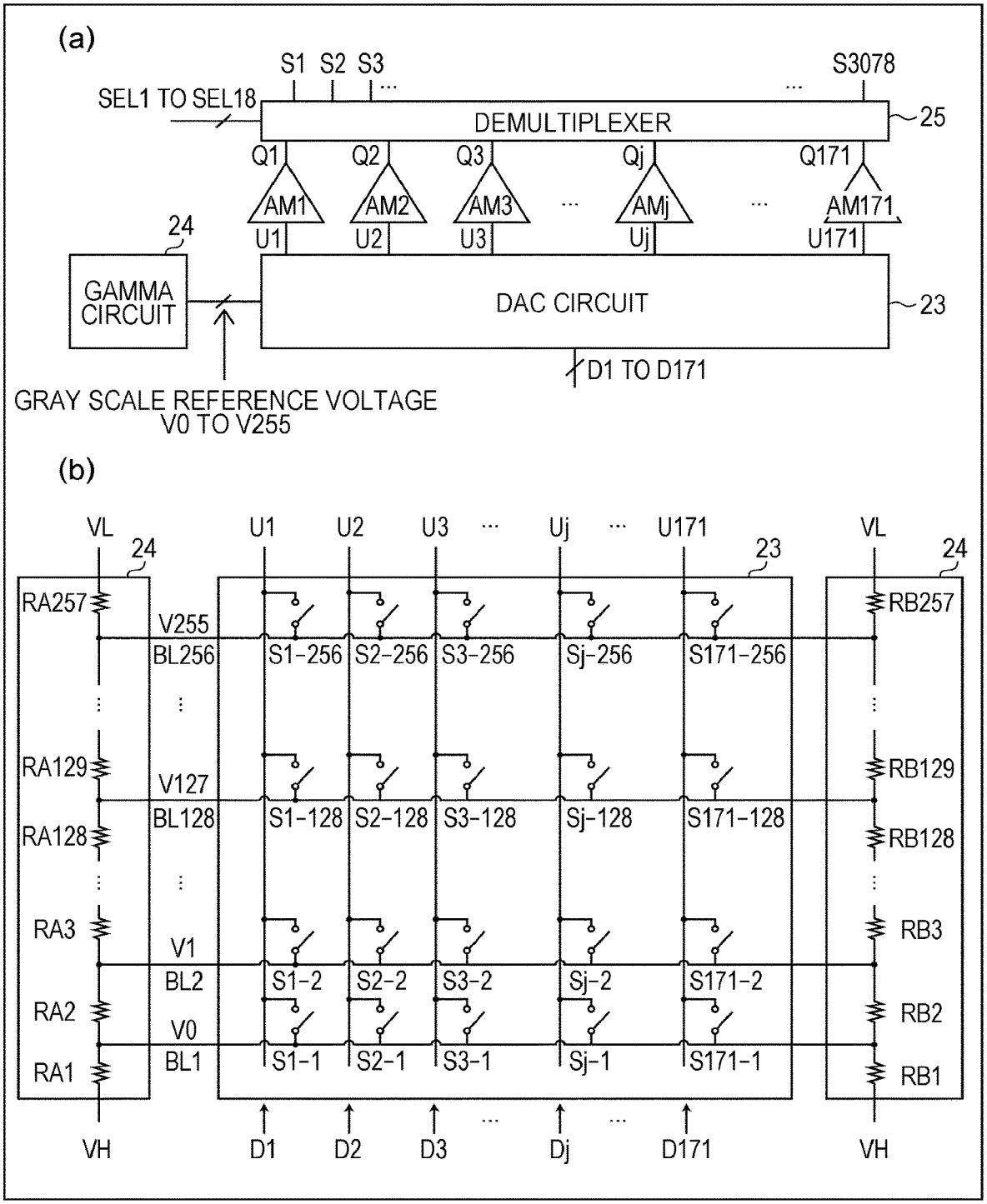
FIG. 11 is a diagram illustrating a conventional source drive circuit that performs multiplexed driving where multiple source lines are driven in time division.
Figure 12:
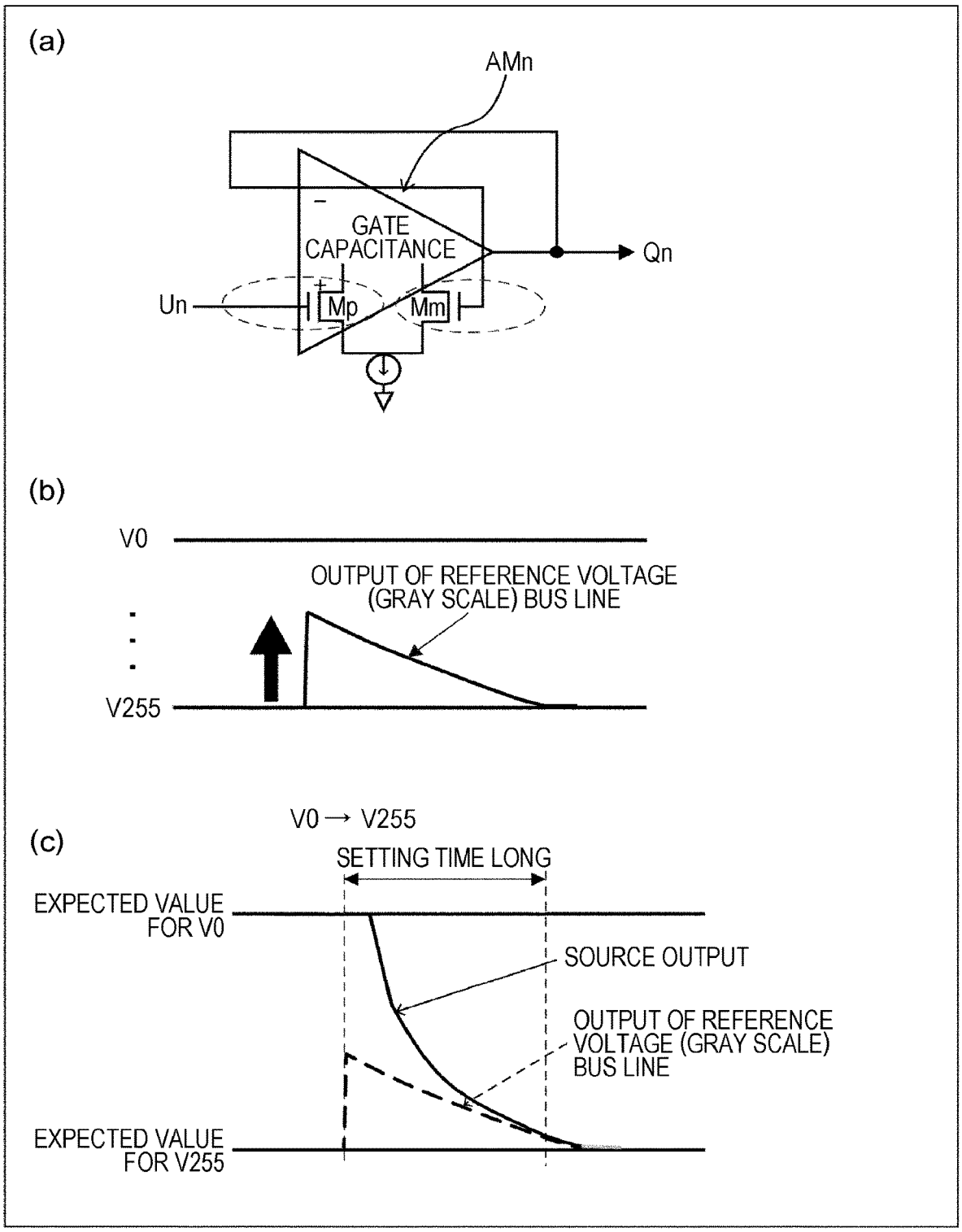
FIG. 12 is a diagram for describing a problem of the conventional source drive circuit illustrated in FIG. 11.
Figure 13:
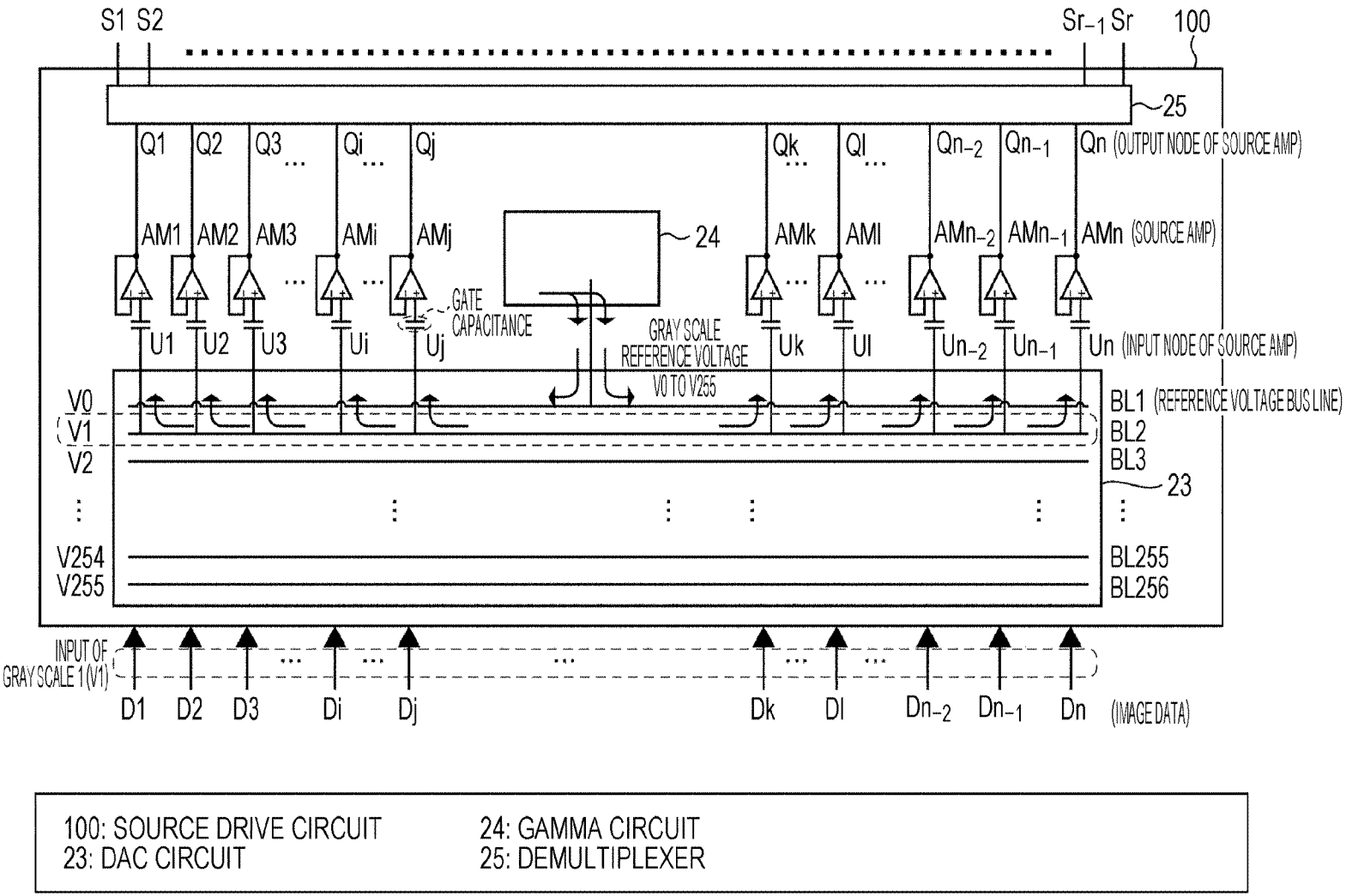
FIG. 13 is a diagram for describing a case where the problem becomes markedly pronounced in the conventional source drive circuit.

Note that the multiple source amps AM1 through AMn are of the same configuration as the configuration provided to the conventional source drive circuit illustrated in FIG. 11. The DAC circuit 2 differs from, the DAC circuit 23 provided to the conventional source drive circuit illustrated in FIG. 11, in that it is provided with power source lines DCL1 through DCL3 for discharging, to which discharging reference voltages V0, V128, and V255 are respectively supplied. The gamma circuit 24*a* also differs from the gamma circuit 24 provided to the conventional source drive circuit illustrated in FIG. 11, in that it supplies gray scale reference voltages V0 through V255 to each of the reference voltage bus lines BL1 through BL256, and also supplies the discharging reference voltages V0, V128, and V255 to the power source lines DCL1 through DCL3 for discharging, respectively.

Although illustration of switch elements is omitted in the DAC circuit 2 illustrated in FIG. 1, switch elements S1-1 through S171-256 are provided between each of the multiple source amps AM1 through AMn and each of the reference; voltage bus lines BL1 through BL256, in the same way as the DAC circuit 23 provided to the conventional source drive circuit illustrate in FIG. 11.

Figure 2:
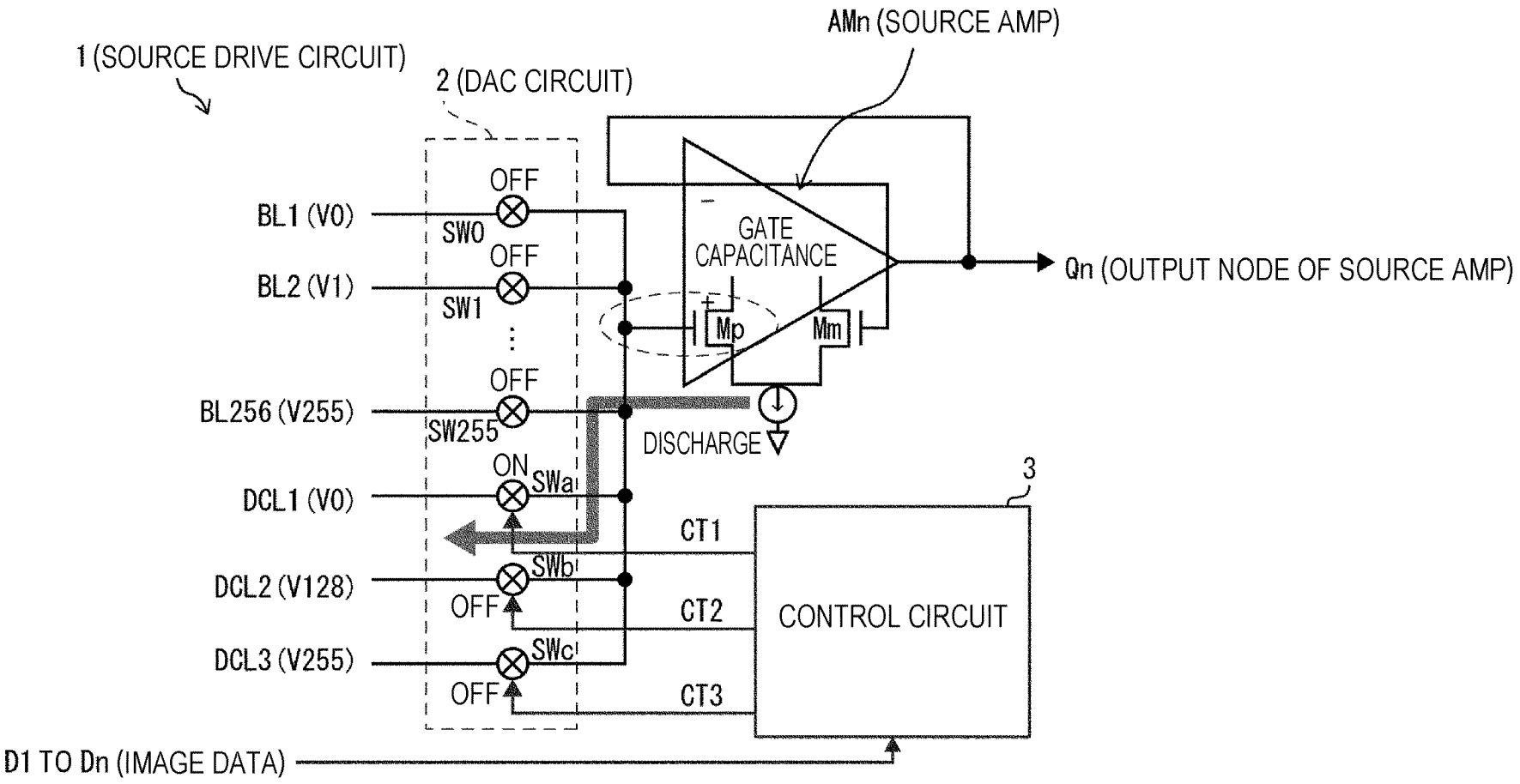
FIG. 2 is a partially enlarged diagram of portion A of the source drive circuit illustrated in FIG. 1.

Also, switch elements SWa through SWc are connected between each of the multiple source amps AM1 through AMn and each of the power source lines DCL1 through DCL3 for discharge, as illustrated in FIG. 2. Specifically, the switch element SWa is connected between each of the multiple source amps AM1 through AMn and the power source line DCL1 for discharge, the switch element SWb is connected between each of the multiple source amps AM1 through AMn and the power source line DCL2 for discharge, and the switch element SWc is connected between each of the multiple source amps AM1 through AMn and the power source line DCL3 for discharge.

Although an example has been described in the present embodiment regarding a case where the power source lines DCL1 through DCL3 for discharge are included in the DAC circuit 2, this is not restrictive, and the power source lines DCL1 through DCL3 for discharge may be provided outside of the DAC circuit 2.

Also, although an example has been described in the present embodiment regarding a case where three power source lines DCL1 through DCL3 for discharge are provided, this is not restrictive, and it is sufficient for the number of power source lines for discharge to be one or more.

Also, although an example will be described in the present embodiment regarding a case where three types of gray scale reference voltages V0, V128, and V255 selected from, the gray scale reference voltages V0 through V255 supplied to the reference voltage bus lines BL1 through BL256 are supplied to each of the three power source lines DCL1 through DCL3 for discharge, this is not restrictive, and voltage other than the gray scale reference voltages V0 through V255 supplied to the reference voltage bus lines BL1 through BL256 may be supplied to the power source lines for discharge.

Although an example will be described in the present embodiment regarding the source drive circuit 1 having the demultiplexer 25, it is needless to say that the present invention is also applicable to a source drive circuit that does not have a demultiplexer 25.

(Regarding Control Circuit 3)

FIG. 2 is a partially enlarged diagram of a portion A of the source drive circuit 1 illustrated in FIG. 1.

The switch elements SW0 through SW255 in FIG. 2 are equivalent to the switch elements S171-1 through S171-256 in the DAC circuit 23 provided to the conventional source drive circuit illustrated in FIG. 11.

FIG. 2 illustrates a case of temporarily discharging the input of source amp AMn to power source line DCL1 for discharge out of the power source lines DCL1 through DCL3 for discharge that are different from the reference voltage bus lines BL1 through BL256, at the timing of the image data D1 through Dn switching from, gray scale 255 (V255) to gray scale 0 (V0).

That is to say, the source drive circuit 1 according to the present embodiment is arranged so that each input node Un of the multiple source amps AMn are electrically connected to the power source line DCL1 (V0) for discharge having potential closest to the gray scale 0 (V0) that is the gray scale reference voltage that the DAC circuit 2 selects next, at the timing of the image data D1 through Dn switching from gray scale 255 (V255) to gray scale 0 (V0), but this is not restrictive.

Accordingly, charge accumulated at the gate capacitance (indicated by dotted lines in the drawing) of the input transistor Mp of the source amp AMn can be allowed to escape, and the input side of the source amp AMn can connect to the reference voltage bus line BL1 (V0) out of the reference voltage bus lines BL1 through BL256 in a discharged state, so fluctuation in potential of the reference voltage bus line BL1 (V0) can be suppressed. Accordingly, a source drive circuit 1 where settling time (stabilization time) is shortened can be realized.

Note that the source amp AMn has an output transistor Mm as well as the input transistor Mp, which is illustrated.

Figure 3:
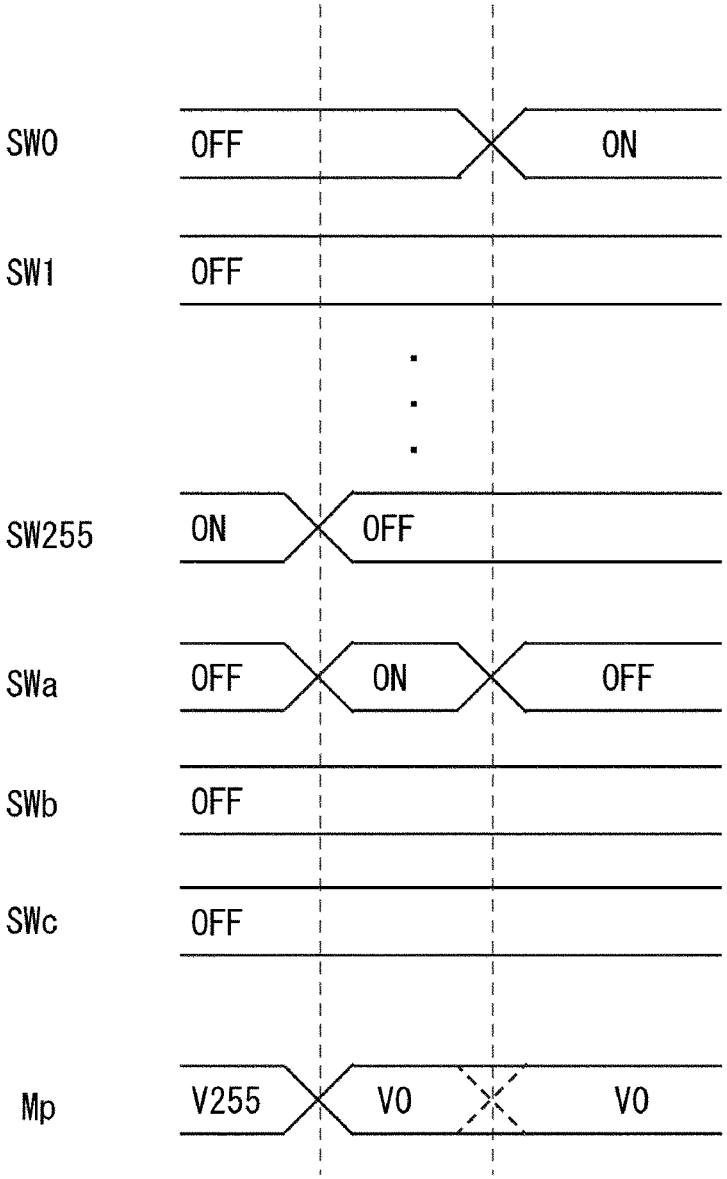
FIG. 3 is a timing chart illustrating on/off timing of switch elements provided to the source drive circuit illustrated in FIG. 2, and input signals of multiple source amps.

FIG. 3 is a timing chart illustrating the on/off timing of the switch elements SW0 through SW255 and SWa through SWc provided to the source drive circuit 1, and input signals of the multiple source amps AMn (potential of input transistor Mp).

As illustrated in FIG. 3, it is the timing of the image data D1 through Dn to switch from gray scale 255 (V255) to gray scale 0 (V0), so the switch elements SW1 through SW254 maintain an off state, and after the switch element SW255 switches from on to off, the switch element SW0 switches from off to on after a predetermined period indicated by dotted lines in the drawing.

The switch element SWa out of the switch elements SWa through SWc goes on during this predetermined period indicated by dotted lines in the drawing, i.e., during the period where the switch element SW255 is on (first period) and period where the switch element SW0 is on (second period), the power source line DCL1 (V0) for discharge and the input of the source amp AMn are electrically connected, and the input of the source amp AMn is discharged to the power source line DCL1 (V0) for discharge. Accordingly, the input signals of the multiple source amps AMn (potential of input transistor Mp) can be made to be V0, which is the potential of the power source line DCL1 for discharge, during the predetermined period indicated by clotted lines in the drawing.

In the present embodiment, the image data D1 through Dn switches from gray scale 255 (V255) to gray scale 0 (V0), so the control circuit 3 judges from the gray scale values of the image data D1 through Dn and selects a power source line DCL1 (V0) for discharge where the potential is the closest to the gray scale reference voltage selected by the DAC circuit 2 next, out of the power source lines DCL1 through DCL3 for discharge, and discharges, but this is not restrictive.

Although an example is described in the present embodiment regarding an arrangement where the control circuit 3 obtains an average gray scale value of the gray scale values of each of the image data D1 through Dn, and the power source line for discharging that has the closest potential out of the power source lines DCL1 through DCL3 for discharge is selected, this is not restrictive. An arrangement may be made where the power source line for discharging that has the closest potential out of the power source lines DCL1 through DCL3 for discharge is selected based on the gray scale values of each of the image data D1 through Dn, although the number of control signals output from the control circuit 3 will increase.

(Display Device 10)

Figure 4:
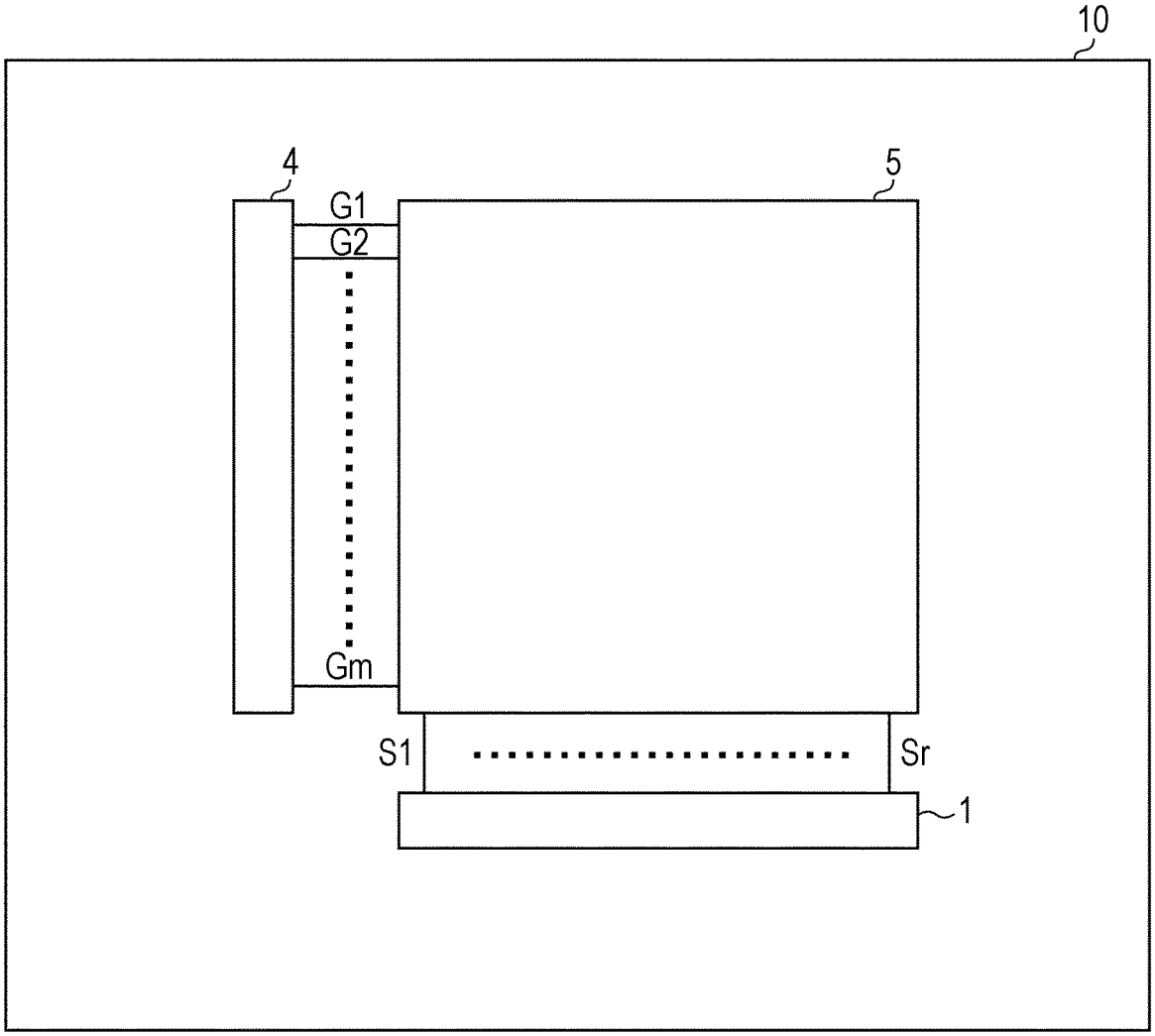
FIG. 4 is a diagram illustrating the overall configuration of a display device having the source drive circuit illustrated in FIG. 1.

FIG. 4 is a diagram, illustrating the overall configuration of a display device 10 including the source drive circuit 1 illustrated in FIG. 1.

The display device 10 includes the source drive circuit 1, a gate drive circuit 4, and a display panel 5. Output signals from the source drive circuit 1 are supplied to the display panel 5 via source lines S1 through Sr, output signals from the gate drive circuit 4 are supplied to the display panel 5 via gate lines G1 through Gm, and display is performed at the display panel 5.

The display panel 5 may be, for example, a liquid crystal display panel, an organic EL (Electro Luminescence: electroluminescence) panel having OLED (Organic Light Emitting Diode: organic light-emitting diodes), or the like.

The display device 10 has the source drive circuit 1 where the settling time (stabilization time) has been shortened as described above, so insufficient gray level in display, display noise, uneven display, and so forth, can be suppressed.

Second Embodiment

A second embodiment of the present invention will be described below. For the sake of convenience, members having the same functions as the members described in the first embodiment above are denoted with the same symbols, and description thereof will not be repeated.

Figure 5:
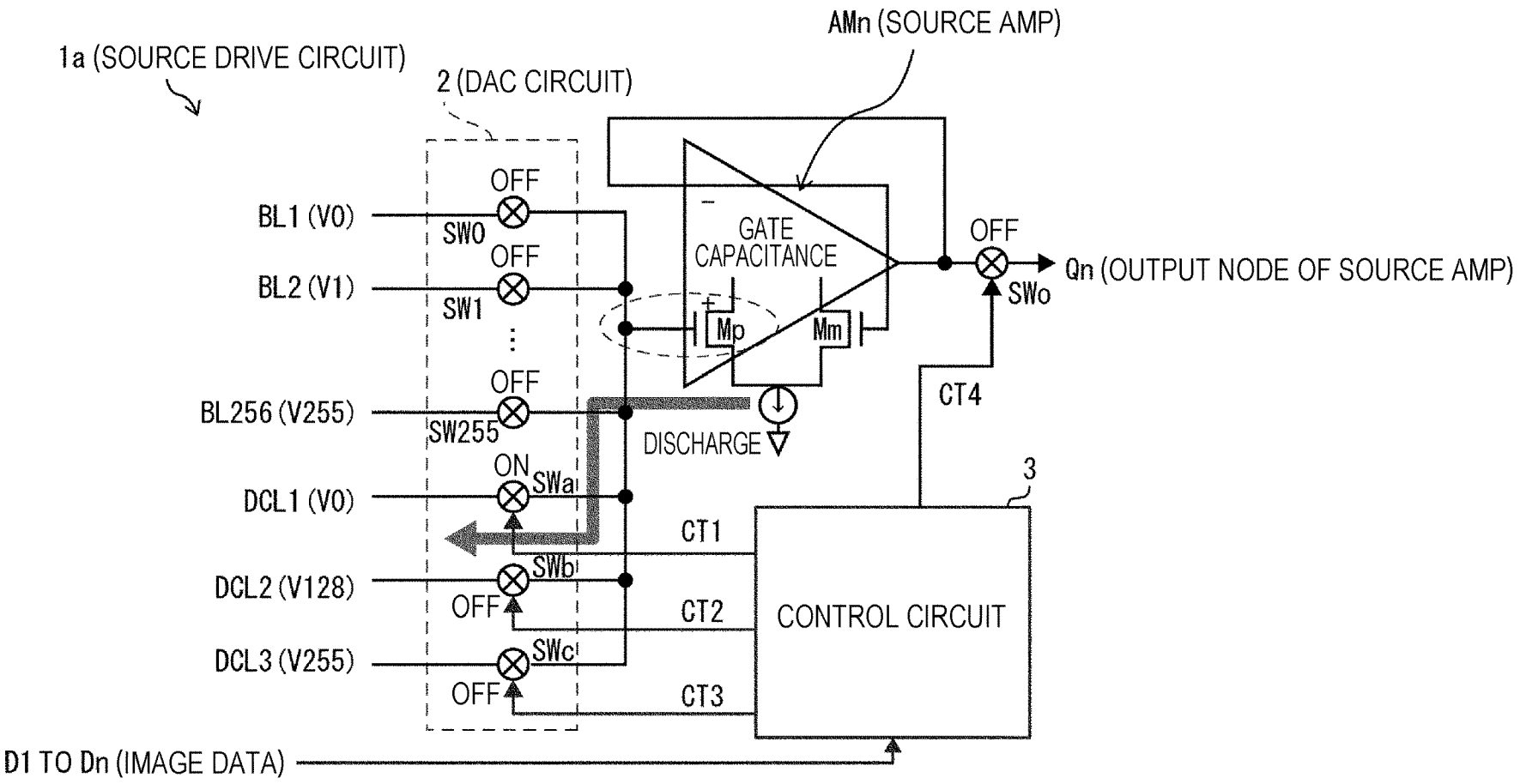
FIG. 5 is a diagram illustrating a part of a source drive circuit according to a second embodiment of the present invention.

FIG. 5 is a diagram, illustrating part of a source drive circuit 1*a* according to the second embodiment.

The source drive circuit 1*a* differs from the source drive circuit 1 described in the first embodiment with regard to the point that a switch element SWo controlled by a control signal CT4 output from the control circuit 3 is provided, to the output node Qn side of the multiple source amps AMn, as illustrated in the drawing.

The switch element SWo provided to the output node Qn side of the multiple source amps AMn goes off at the timing of one of the switch elements SWa through SWc going on, thereby isolating the output nodes Qn of the multiple source amps AMn from the load of the display panel, thereby suppressing potential fluctuation at the output node Qn side of the multiple source amps AMn.

Figure 6:
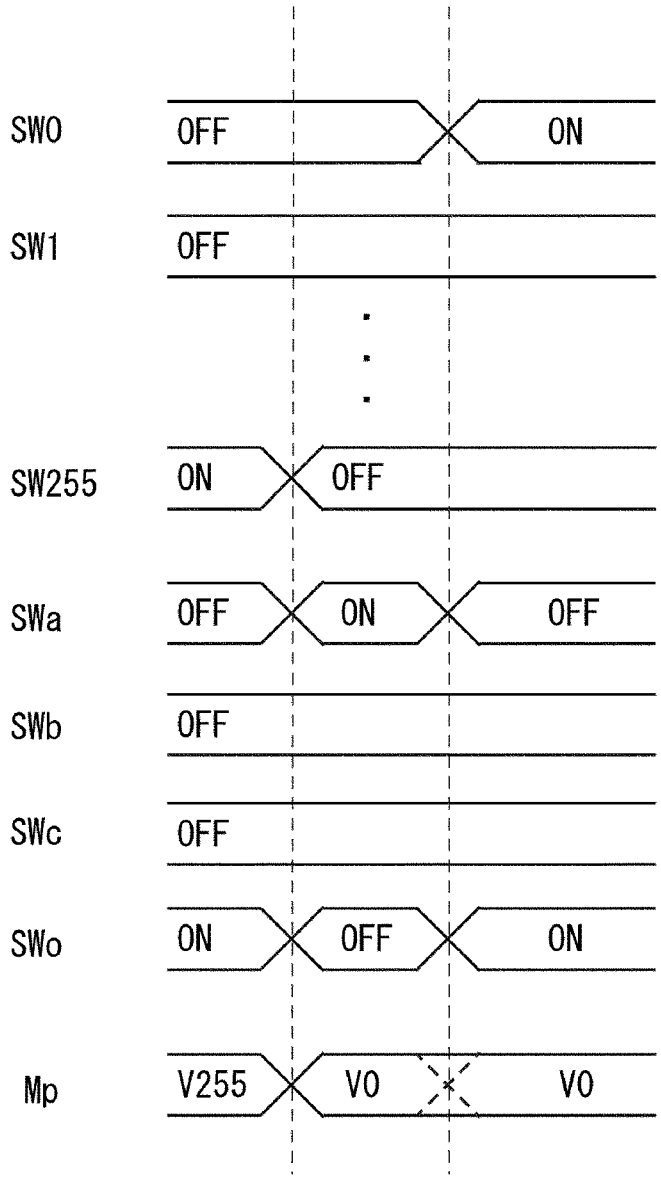
FIG. 6 is a timing chart illustrating on/off timing of switch elements provided to the source drive circuit illustrated in FIG. 5, and input signals of multiple source amps.

FIG. 6 is a timing chart illustrating the on/off timing of the switch elements SW0 through SW255 and SWa through SWc, SWo, provided to the source drive circuit 1*a*, and input signals of the multiple source amps AMn (potential of input transistor Mp).

As illustrated in FIG. 6, it is the timing of the image data D1 through Dn to switch from gray scale 255 (V255) to gray scale 0 (V0), so the switch elements SW1 through SW254 maintain an off state, and after the switch element SW255 switches from on to off, the switch element SW0 switches from off to on after a predetermined period indicated by dotted lines in the drawing.

The switch element SWa out of the switch elements SWa through SWc goes on during this predetermined period indicated by dotted lines in the drawing, the power source line DCL1 (V0) for discharge and the input of the source amp AMn are electrically connected, and the input of the source amp AMn is discharged to the power source line DCL1 (V0) for discharge. The switch element SWo then goes off at the timing of the switch element SWa going on, and goes on at the timing of the switch element SWa going off. Accordingly, the switch element SWo maintains off during the predetermined period indicated by dotted lines in the drawing, thereby isolating the output node Qn of the multiple source amps AMn from the load of the display panel, and suppressing fluctuation of potential at the output node Qn side of the multiple; source amps AMn.

According to the above configuration, a source drive circuit 1*a* can be realized where effects on the display panel side are suppressed during discharge of the input of the source amps AMn, and settling time (stabilization time) is shortened.

Third Embodiment

A third embodiment of the present invention will be described below. For the sake of convenience, members having the same functions as the members described in the first and second embodiments above are denoted with the same symbols, and description thereof will not be repeated.

Figure 7:
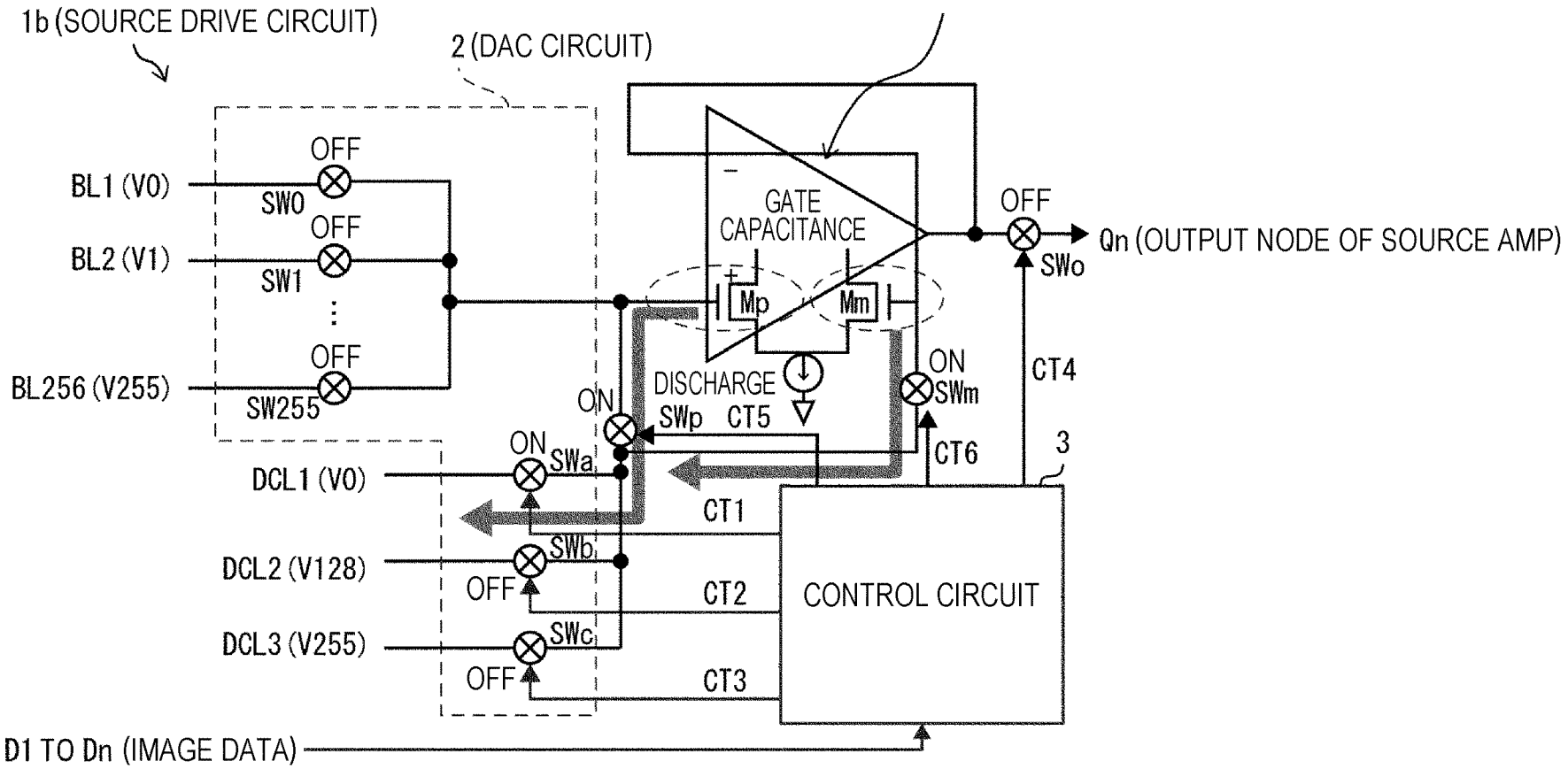
FIG. 7 is a diagram illustrating a part of a source drive circuit according to a third embodiment of the present invention.

FIG. 7 is a diagram, illustrating part of a source drive circuit 1*b* according to the third embodiment.

The source drive circuit 1*b* differs from the source drive circuit 1*a* described in the second embodiment with regard to the point that a switch element SWp that is connected to the input transistor Mp provided to the multiple source amps AMn and controlled by a control signal CT5 output from the control circuit 3, and a switch element SWm that is connected to the output transistor: Mm provided to the multiple source amps AMn and controlled by a control signal CT6 output from the control circuit 3, are provided, as illustrated, in the drawing.

The switch element SWp and switch element SWm go on at the timing of one of the switch elements SWa through SWc going on, and discharge the gate capacitance (illustrated by dotted lines in the drawing) of the input transistor Mp and the gate capacitance (illustrated by dotted lines in the drawing) of the output transistor Mm at the same time.

Figure 8:
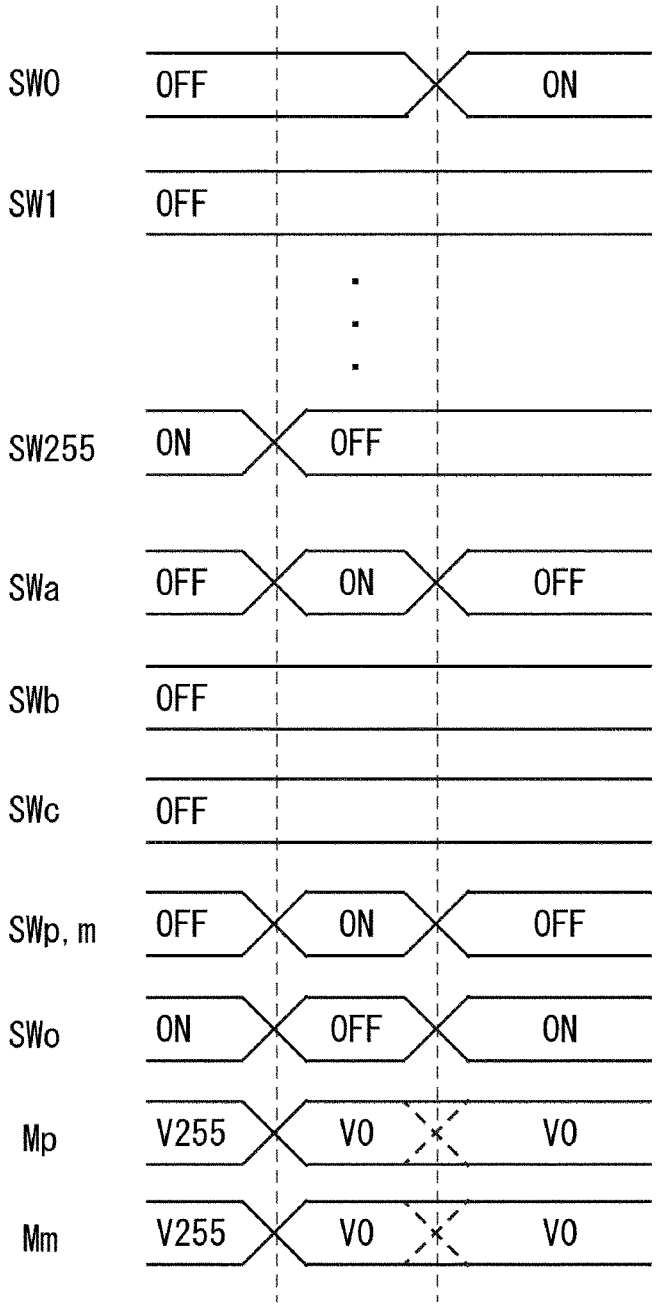
FIG. 8 is a timing chart illustrating on/off timing of switch elements provided to the source drive circuit illustrated in FIG. 7, and input signals and output signals of multiple source amps.

FIG. 8 is a timing chart illustrating the on/off timing of the switch elements SW0 through SW255 and SWa through SWc, SWo, SWp, and SWm provided to the source drive circuit 1*b*, and input signals of the multiple source amps AMn (potential of input transistor Mp) and output signals (potential of output transistor Mm).

As illustrated in FIG. 8, it is the timing of the image data D1 through Dn to switch from gray scale 255 (V255) to gray scale 0 (V0), so the switch elements SW1 through SW254 maintain an off state, and after the switch element SW255 switches from on to off, the switch element SW0 switches from off to on after a predetermined period indicated by dotted lines in the drawing.

The switch element SWa out of the switch elements SWa through SWc, the switch element SWp, and the switch element SWm, go on during this predetermined period indicated by dotted lines in the drawing, and the gate capacitance of the input transistor Mp and the gate capacitance of the output transistor Mm are discharged to the power source line DCL1 (V0) for discharge at the same time.

Thus, even in a case where interchanging of the input transistor Mp and output transistor Mm occurs due to offset cancelling operations, a situation where undischarged gate capacitance is connected to the reference voltage bus line does not occur, and the effects on the reference voltage bus line can be reduced. Also, offset-cancelling switch elements may be used, for the switch, element SWp connected to the input transistor Mp and the switch element SWp connected to the output transistor Mm.

The switch, element SWo then goes off at the timing of the switch element SWa going on, and goes on at the timing of the switch element SWa going off. Accordingly, the switch element SWo maintains off during the predetermined period indicated by dotted lines in the drawing, thereby isolating the output node Qn of the multiple source amps AMn from, the load of the display panel, and suppressing fluctuation of potential at the output node Qn side of the multiple source amps AMn.

According to the above configuration, a source drive circuit 1*b* can be realized where effects on the reference voltage bus line can be reduced even in a case where interchanging of the input transistor Mp and output transistor Mm occurs due to offset cancelling operations, effects on the display panel side are suppressed during discharge of the input of the source amps AMn, and settling time (stabilization time) is shortened.

Fourth Embodiment

A fourth embodiment of the present invention will be described below. For the sake of convenience, members having the same functions as the members described in the first embodiment above are denoted with the same symbols, and description thereof will not be repeated.

Figure 9:
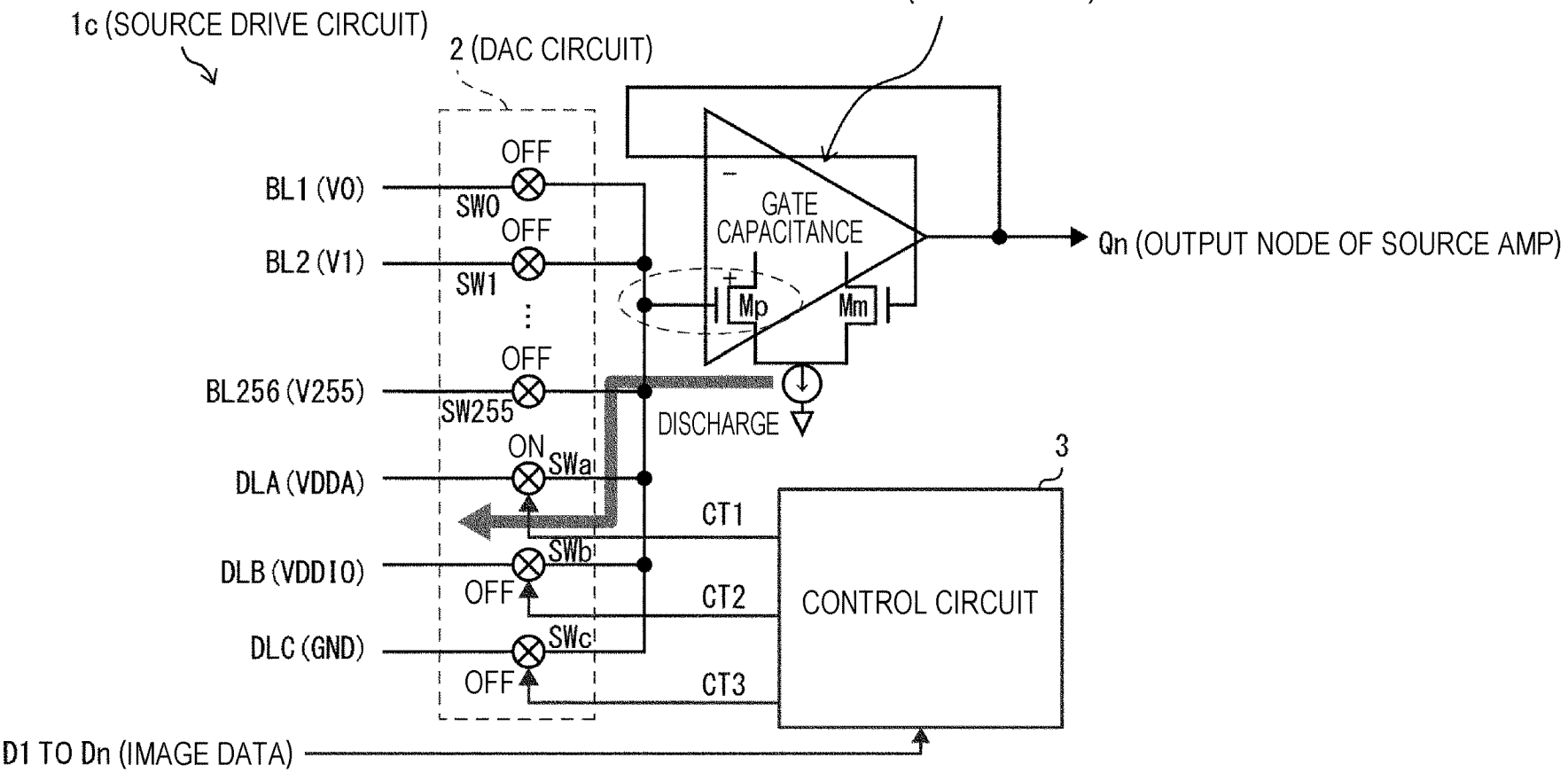
FIG. 9 is a diagram illustrating a part of a source drive circuit according to a fourth embodiment of the present invention.

FIG. 9 is a diagram illustrating part of a source drive circuit 1*c* according to the fourth embodiment.

The state of the switch elements SW0 through SW255 and switch element SWa through SWc provided to the source drive circuit 1*c* illustrated in FIG. 9 is a state at the timing where the image data D1 through Dn switches from, gray scale 255 (V255) to gray scale 0 (V0). Note that a timing chart illustrating the on/off timing of the switch elements SW0 through SW255 and switch element SWa through SWc provided to the source drive circuit 1*c*, and the input signals of the multiple source amps AMn (potential of input transistor Mp) is the same as FIG. 3, and accordingly is not illustrated here.

The source drive circuit 1*c* uses three external power source lines DLA through DLC for example, instead of the power source lines DCL1 through DCL3 for discharging in the above-described first through, third embodiments, as illustrated in FIG. 9. The external power source line DLA has level VDDA, the external power source line DLB has level VDDIO, and the external power source line DLC has level GND. The potential of these is that VDDA level is higher than VDDIO level, and VDDIO level is higher than GND level.

In the present embodiment, the external power source line DLA at VDDA level doubles as a digital circuit power source line used in the source drive circuit 1*c*. The digital circuit power source line is also used by the control circuit 3. The external power source line DLB at VDDIO level doubles as an interface power source line connecting the source drive circuit 1*c* with circuits other than the source drive circuit 1*c*. The external power source line DLC at GND level doubles as a GND (ground) line of the source drive circuit 1*c*.

An example is described in the present embodiment regarding an arrangement where the image data D1 through Dn switches from gray scale 255 (V255) to gray scale 0 (V0), so the control circuit 3 judges from the gray scale values of each of the image data D1 through Dn, and selects the external power source line DLA (VDDA) that has the closest potential to the gray scale reference voltage that the DAC circuit 2 will select next out of the three external power source lines DLA through DLC, to perform discharging, but this is not restrictive.

According to the above configuration, a source drive circuit 1*c* where settling time (stabilization time) is shortened can be realized.

Fifth Embodiment

A fifth embodiment of the present invention will be described below. For the sake of convenience, members having the same functions as the members described in the first embodiment above are denoted with the same symbols, and description thereof will not be repeated.

Figure 10:
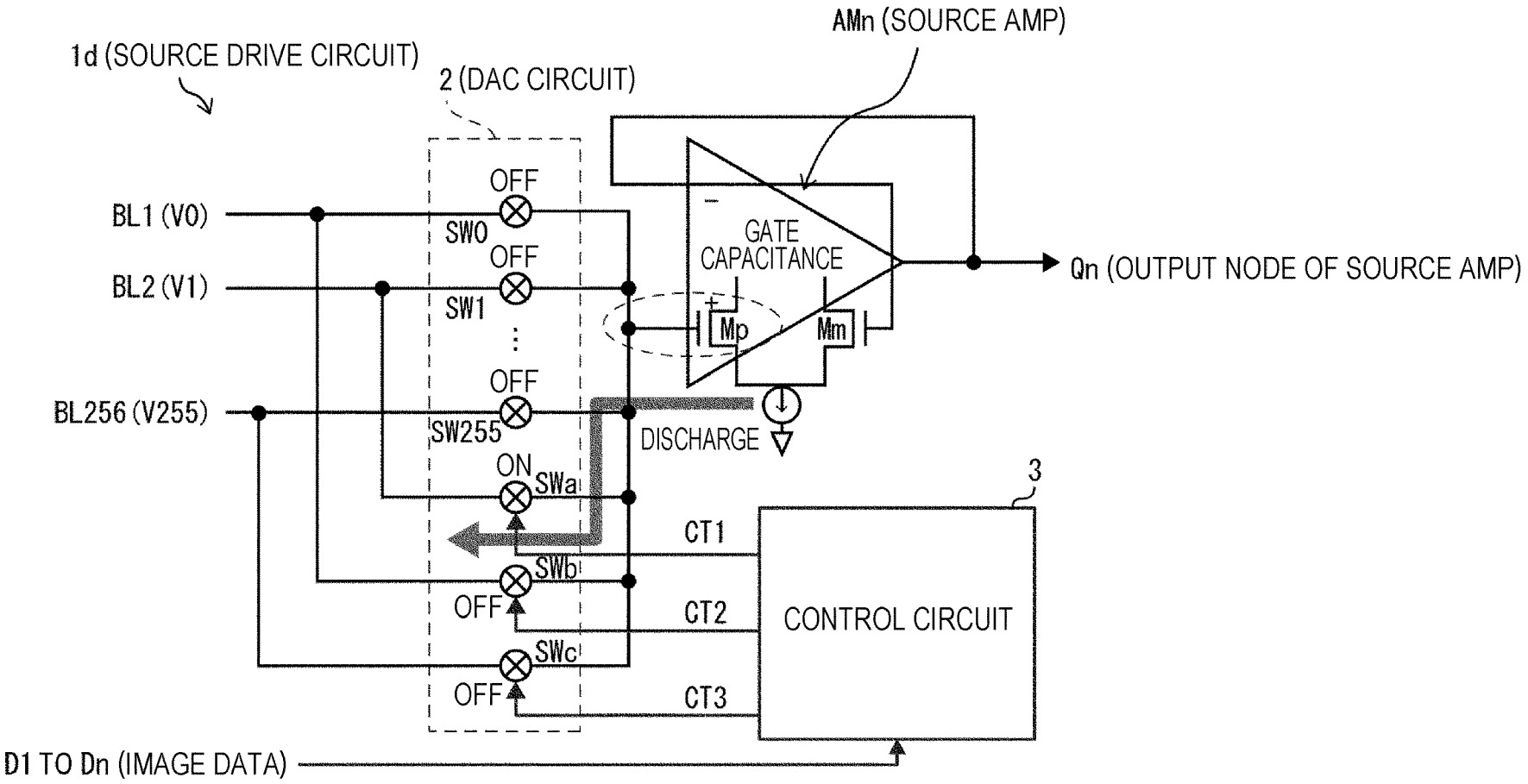
FIG. 10 is a diagram illustrating a part of a source drive circuit according to a fifth embodiment of the present invention.

FIG. 10 is a diagram illustrating part of a source drive circuit 1*d* according to the fifth embodiment.

The state of the switch elements SW0 through SW255 and switch element SWa through SWc provided to the source drive circuit 1*d* illustrated in FIG. 10 is a state at the timing where the image data D1 through Dn switches from gray scale 255 (V255) to gray scale 0 (V0). Note that a timing chart illustrating the on/off timing of the switch elements SW0 through SW255 and switch element SWa through SWc provided to the source drive circuit 1*d*, and the input signals of the multiple source amps AMn (potential of input transistor Mp) is the same as FIG. 3, and accordingly is not illustrated here.

The source drive circuit 1*d* uses, for example, reference voltage bus line BL1 (V0), reference voltage bus line BL2 (V1), and reference voltage bus line BL256 (V255), which are part of the reference voltage bus lines BL1 through BL256, instead of the power source lines DCL1 through DCL3 for discharging in the above-described first through third embodiments, as illustrated in FIG. 10.

An example is described in the present embodiment regarding an arrangement where the image data D1 through Dn switches from gray scale 255 (V255) to gray scale 0 (V0), so the control circuit 3 judges from the gray scale values of each of the image data D1 through Dn, and selects the reference voltage bus line BL2 (V1) that has the closest potential to the gray scale reference voltage that the DAC circuit 2 will select next, out of the three reference voltage bus line BL1 (V0), reference voltage bus line BL2 (V1), and reference voltage bus line BL256 (V255), to perform discharging, but this is not restrictive. An arrangement may be made where the reference voltage bus line BL1 (V0) that has the closest potential to the gray scale reference voltage that the DAC circuit 2 will select next is selected, and discharging is performed.

According to the above configuration, a source drive circuit 1*d* where settling time (stabilization time) is shortened can be realized.

The present invention is not restricted to the above-described embodiments. Various modifications may be made within the scope set forth in the Claims, and embodiments obtained by appropriately combining technical means disclosed in each of different embodiments are also included in the technical scope of the present invention. Further, new technical features can be formed by combining technical means disclosed in the embodiments.

REFERENCE SIGNS LIST

1, 1*a*, 1*b*, 1*c*, 1*d* source drive circuit (drive circuit)
2, 23 DAC circuit (digital/analog conversion circuit)
3 control circuit
4 gate drive circuit
5 display panel
10 display device
24, 24*a* gamma circuit (gray scale reference voltage generating circuit)
25 demultiplexer
D1 through Dn image data
AM1 through AMn source amp
Q1 through Qn output node of source amp
U1 through Un input node of source amp
BL1 through BL256 reference voltage bus line
DCL1 through DCL3 power source line for discharge
DLA through DLC external power source line
SW0 through SW255 switch element
SWa through SWc switch element
SWo switch element
SWp switch element
SWm switch element
Mp input transistor
Mm output transistor
S1 through Sr source line
G1 through Gm gate line

The invention claimed is:

1. A drive circuit comprising: a plurality of source amps; a gray scale reference voltage generating circuit that generates M (where M is a natural number of 2 or greater) different gray scale reference voltages; a digital-to-analog conversion circuit that selects one of the M gray scale reference voltages supplied from the gray scale reference voltage generating circuit via corresponding one of M bus lines, based on corresponding one of input gray scale values, and supplies the one of the M gray scale reference voltages to one of the plurality of source amps;

at least one power source line; and a control circuit that controls the digital-to-analog conversion circuit, wherein the control circuit makes the digital-to-analog conversion circuit select one of the at least one power source line as a selected power source line, and make one input node of one of the plurality of source amps electrically connect to the selected power source line during a predetermined period being between a first period in which the digital-to-analog conversion circuit supplies a current gray scale reference voltage of the M gray scale reference voltages to the one input node and a second period in which the digital-to-analog conversion circuit supplies a next gray scale reference voltage of the M gray scale reference voltages to the one input node, wherein the control circuit makes the digital-to-analog conversion circuit discharge charge accumulated at the one input node of one of the plurality of source amps to the selected power source line during the predetermined period, wherein the predetermined period is a timing of switching from the current gray scale reference voltage to the next gray scale reference voltage, wherein the control circuit further comprises:

a first switch element electrically connected to the selected power source line, the first switching element going on when the charge accumulated at the one input node is discharged to the selected power source line; and a second switch element electrically connected to an output node of one source amp of the plurality of source amps, the one source amp being electrically connected to the one input node, and controlled by a control signal output from the control circuit, and wherein the control circuit controls the second switch element to be off at a timing of the first switching element being on.

2. The drive circuit according to claim 1, wherein the selected power source line has a potential closest to the next gray scale voltage that the control circuit makes the digital-to-analog conversion circuit select next.

3. The drive circuit according to claim 1, wherein each of the plurality of source amps is provided with an input transistor at the input node side, and an output transistor at an output node side, and wherein the input transistor and the output transistor are electrically connected to one of the at least one power source line during the predetermined period being between the first period and the second period.

4. The drive circuit according to claim 1, wherein the at least one power source line is a power source line that is different from the bus lines, and is a power source line for discharging to which one of the gray scale reference voltages is supplied.

5. The drive circuit according to claim 1, wherein the at least one power source line is an external power source line.

6. The drive circuit according to claim 1, wherein the at least one power source line is part of the M bus lines.

7. A display device comprising: the drive circuit according to claim 1; and a display panel.

8. The display device according to claim 7, wherein the second switch element is provided to the output node of each of the plurality of source amps, and wherein the second switch element is in an off state where the output node of each of the plurality of source amps and the display panel are electrically isolated during the predetermined period being between the first period and the second period.

9. The drive circuit according to claim 1, wherein the control circuit makes the digital-to-analog conversion circuit discharge the charge accumulated at the one input node of one of the plurality of source amps to the selected power source line only during the timing of switching from the current gray scale reference voltage to the next gray scale reference voltage.

10. A drive circuit comprising: a plurality of source amps; a gray scale reference voltage generating circuit that generates M (where M is a natural number of 2 or greater) different gray scale reference voltages; a digital-to-analog conversion circuit that selects one of the M gray scale reference voltages supplied from the gray scale reference voltage generating circuit via corresponding one of M bus lines, based on corresponding one of input gray scale values, and supplies the one of the M gray scale reference voltages to one of the plurality of source amps;

at least one power source line; and a control circuit that controls the digital-to-analog conversion circuit, wherein the control circuit makes the digital-to-analog conversion circuit select one of the at least one power source line as a selected power source line, and make one input node of one of the plurality of source amps electrically connect to the selected power source line during a predetermined period being between a first period in which the digital-to-analog conversion circuit supplies a current gray scale reference voltage of the M gray scale reference voltages to the one input node and a second period in which the digital-to-analog conversion circuit supplies a next gray scale reference voltage of the M gray scale reference voltages to the one input node, wherein the control circuit makes the digital-to-analog conversion circuit discharge charge accumulated at the one input node of one of the plurality of source amps to the selected power source line during the predetermined period, wherein the control circuit further comprises:

a first switch element electrically connected to the selected power source line, the first switching element going on when the charge accumulated at the one input node is discharged to the selected power source line; and a second switch element electrically connected to an output node of one source amp of the plurality of source amps, the one source amp being electrically connected to the one input node, and controlled by a control signal output from the control circuit, wherein the predetermined period is a timing of switching from the current gray scale reference voltage to the next gray scale reference voltage, and wherein the second switch element maintains off during the predetermined period.

* * * * *